US009244395B2

(12) United States Patent
Takagi et al.

(10) Patent No.: US 9,244,395 B2
(45) Date of Patent: Jan. 26, 2016

(54) IMAGE FORMING APPARATUS TO CONTROL SHEET CONVEYANCE SPEED

(71) Applicant: CANON KABUSHIKI KAISHA, Tokyo (JP)

(72) Inventors: Kenji Takagi, Odawara (JP); Keita Nakajima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/257,893

(22) Filed: Apr. 21, 2014

(65) Prior Publication Data

US 2014/0321871 A1 Oct. 30, 2014

(30) Foreign Application Priority Data

Apr. 25, 2013 (JP) ..... 2013-092116

(51) Int. Cl.
*G03G 15/00* (2006.01)
*G03G 15/20* (2006.01)
*B65H 9/00* (2006.01)

(52) U.S. Cl.
CPC ..... *G03G 15/2028* (2013.01); *B65H 9/002* (2013.01); *G03G 15/657* (2013.01); *G03G 15/6564* (2013.01); *G03G 15/6567* (2013.01); *B65H 2511/242* (2013.01); *B65H 2701/1131* (2013.01); *G03G 2215/00561* (2013.01)

(58) Field of Classification Search
CPC ..... G03G 15/6567; G03G 15/6564; G03G 2215/00561; G03G 15/657; G03G 15/2028; B65H 2511/242; B65H 2701/1311; B65H 9/002
See application file for complete search history.

(56) References Cited

U.S. PATENT DOCUMENTS

2006/0051145 A1* 3/2006 Ubayashi ..... 399/395
2008/0232878 A1* 9/2008 Sekine et al. ..... 399/395

FOREIGN PATENT DOCUMENTS

JP 07-234604 A 9/1995

* cited by examiner

*Primary Examiner* — Joseph S Wong
(74) *Attorney, Agent, or Firm* — Canon USA, Inc. IP Division

(57) ABSTRACT

An image forming apparatus includes a fixing unit, detection units, and a control unit. The control unit switches a sheet speed at the fixing unit to either a first or second sheet speed that is faster than the first sheet speed based on a first detection unit signal where the control unit detects that both a loop amount of a sheet loop at second and third detection unit positions are greater than or less than a predetermined amount. The control unit sets the fixing unit sheet speed as a predetermined sheet speed between the first and second sheet speed where the control unit detects that one of two loop amounts detected the second and third detection units is greater than the predetermined amount when the other one of the two loop amounts is less than the predetermined amount.

13 Claims, 10 Drawing Sheets

LOOP CONTROL FOR NON-LOPSIDED LOOPED STATE

LOOP CONTROL FOR LOPSIDED LOOPED STATE

IMAGE FORMING APPARATUS TO CONTROL SHEET CONVEYANCE SPEED

BACKGROUND OF THE INVENTION

1. Field of the Invention

The present invention relates to an image forming apparatus, and particularly relates to an image forming apparatus which conveys a sheet onto which a toner image has been transferred while causing the sheet to form a loop in a region between a transfer unit and a fixing unit.

2. Description of the Related Art

In a conventional electro-photographic type image forming apparatus, after a toner image formed on an image bearing member is transferred onto a sheet serving as a transfer material by a transfer unit, the toner image is fixed on the sheet by introducing the sheet to a fixing unit and heated thereby. In this case, because the sheet is conveyed while carrying the unfixed toner image, if conveyance of the sheet becomes unstable, a printed surface thereof that carries the unfixed toner image may contact members within the image forming apparatus, and thus the toner image may be damaged to cause a defective image. Further, if a non-printed surface which does not carry the unfixed toner image is scraped against the members within the image forming apparatus, the sheet may be electrically charged to cause the toner image to be damaged, and thus this may result in a defective image to be generated. Furthermore, paper creases may be generated if behavior of the sheet in a conveyance period becomes unstable. Accordingly, it is necessary to stably convey the sheet from the transfer unit to the fixing unit.

Therefore, in the conventional image forming apparatus discussed in Japanese Patent Application Laid-Open No. 07-234604, for example, a loop detection sensor for detecting a loop of the sheet is disposed on a conveyance guide arranged between a fixing unit and a transfer unit, and in order to convey the sheet stably, conveyance speed of the fixing unit is controlled to cause the amount of loop formed on the sheet to be kept within a predetermined range.

However, in the conventional image forming apparatus, there may be a case where the sheet is conveyed from the transfer unit to the fixing unit while warping in a width direction orthogonal to the sheet conveyance direction. In such a case, the sheet will loop while warping in the width direction. Hereinafter, the above-described loop is referred to as "lopsided loop". If the sheet loops lopsidedly as described above, an amount of the loop becomes different at both end portions in the width direction of the sheet. Therefore, it is difficult to appropriately control the loop amount when loop control is executed.

In a case where the loop amount cannot be controlled appropriately, the loop amount will be excessively increased on one side in the width direction to cause a non-printed surface of the sheet to be strongly scraped against the conveyance guide, or conversely, the loop amount will be excessively decreased on one side in the width direction to cause a printed surface of the sheet to contact with members within the image forming apparatus. As described above, if the loop control cannot be executed stably, a problem such as defective images or creases may be generated caused by conveyance failure of the sheet in a region between the transfer unit and the fixing unit.

SUMMARY OF THE INVENTION

The present invention is directed to an image forming apparatus capable of stably conveying a sheet even if a lopsided loop has been generated therein.

According to an aspect of the present invention, an image forming apparatus includes a transfer unit configured to transfer a toner image onto a sheet, a fixing unit configured to fix the toner image transferred onto the sheet by the transfer unit, a sheet conveyance path disposed between the transfer unit and the fixing unit, a first detection unit configured to generate a signal according to a loop of the sheet at a central portion in a width direction orthogonal to a sheet conveyance direction of the sheet conveyance path, a second detection unit configured to generate a signal according to a loop of the sheet on one side in the width direction of the sheet conveyance path, a third detection unit configured to generate a signal according to a loop of the sheet on another side in the width direction of the sheet conveyance path, and a control unit configured to control a sheet conveyance speed at the fixing unit based on the signals from the first detection unit, the second detection unit, and the third detection unit, wherein the control unit switches the sheet conveyance speed at the fixing unit to either a first sheet conveyance speed or a second sheet conveyance speed that is faster than the first sheet conveyance speed based on a signal from the first detection unit in a case where the control unit detects that both a loop amount of a loop of the sheet at a detection position of the second detection unit and a loop amount of a loop of the sheet at a detection position of the third detection unit are greater than a predetermined amount, or detects that both the loop amount of the loop of the sheet at the detection position of the second detection unit and the loop amount of the loop of the sheet at the detection position of the third detection unit are less than the predetermined amount based on the signals from the second detection unit and the third detection unit, and wherein the control unit sets the sheet conveyance speed at the fixing unit as a predetermined sheet conveyance speed between the first sheet conveyance speed and the second sheet conveyance speed in a case where the control unit detects that one of the loop amounts of the sheet at detection positions of the second detection unit and the third detection unit is greater than the predetermined amount based on the signal from the one of the second detection unit and the third detection unit when the other one of the loop amounts of the sheet at detection positions of the second detection unit and the third detection unit is less than the predetermined amount based on the signal from the another one of the second detection unit and the third detection unit.

An image forming apparatus includes a transfer unit configured to transfer a toner image onto a sheet, a fixing unit configured to fix the toner image transferred by the transfer unit on the sheet, and a control unit configured to switch a sheet conveyance speed at the fixing unit to a first sheet conveyance speed or a second sheet conveyance speed that is faster than the first sheet conveyance speed based on a signal from a first detection unit which generates a signal according to a loop of the sheet. In the image forming apparatus, the control unit sets the sheet conveyance speed at the fixing unit as a predetermined sheet conveyance speed between the first sheet conveyance speed and the second sheet conveyance speed in a case where a lopsided loop of the sheet is detected. Further features of the present invention will become apparent from the following description of exemplary embodiments (with reference to the attached drawings).

DESCRIPTION OF THE EMBODIMENTS

Figure 1:
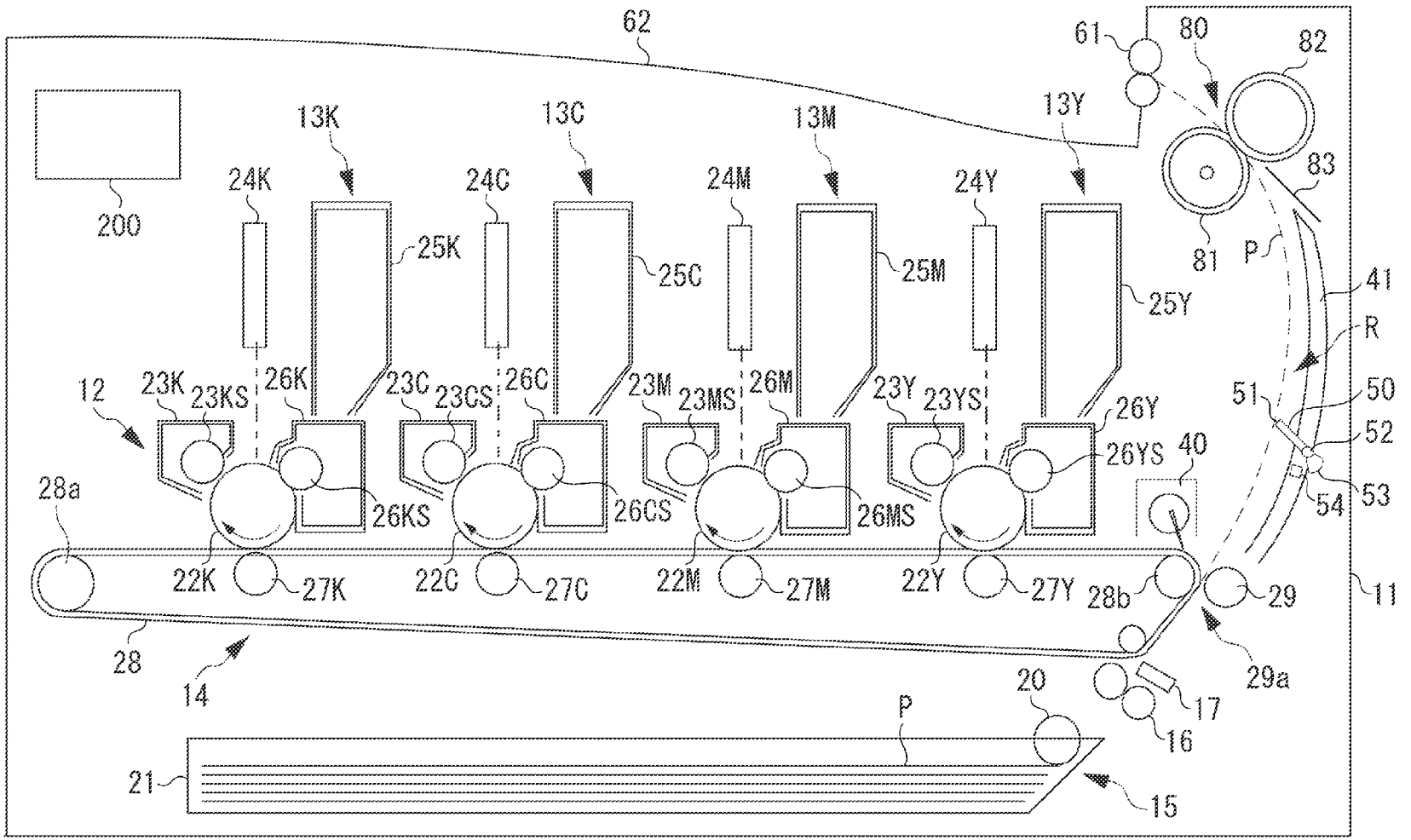
FIG. 1 is a diagram schematically illustrating a configuration of a color laser printer as one example of an image forming apparatus according to a first exemplary embodiment of the present invention.

Various exemplary embodiments, features, and aspects of the invention will be described in detail below with reference to the drawings. FIG. 1 is a diagram schematically illustrating a configuration of a color laser printer as one example of the image forming apparatus according to a first exemplary embodiment of the present invention. In FIG. 1, a color laser printer 10 includes a color laser printer main unit (hereinafter, referred to as printer main unit) 11. The printer main unit 11 serving as an image forming apparatus main unit includes an image forming unit 12 for forming an image on a sheet.

The image forming unit 12 includes photosensitive drums 22 (22Y, 22M, 22C, and 22K) serving as image bearing members which respectively carry toner images in four colors such as yellow, magenta, cyan, and black. Charging units 23 (23Y, 23M, 23C, and 23K) which include charging rollers 23YS, 23MS, 23CS, and 23KS for uniformly charging the surfaces of the photosensitive drums 22 in the rotational direction thereof are disposed on the periphery of the photosensitive drums 22.

Further, scanner units 24 (24Y, 24M, 24C, and 24K) which form electrostatic latent images on the photosensitive drums 22 by emitting laser beam based on image information are disposed on the upper side of the photosensitive drums 22. In addition, development units 26 (26Y, 26M, 26C, and 26K) which include development rollers 26YS, 26MS, 26CS, and 26KS for visualizing the electrostatic latent images as toner images by applying toner thereto are disposed on the periphery of the photosensitive drums 22.

In the present exemplary embodiment, the photosensitive drums 22, the charging units 23, and the development units 26 are respectively included in process cartridges 13 (13Y, 13M, 13C, and 13K). An intermediate transfer belt unit 14 is disposed on the lower side of the process cartridges 13. The intermediate transfer belt unit includes an intermediate transfer belt 28 as a dielectric endless belt having flexibility, a driving roller 28*a* for moving the intermediate transfer belt 28 in a circulating manner, a secondary transfer counter roller 28*b*, and an intermediate transfer belt cleaning unit 40.

The intermediate transfer belt 28 contacts the photosensitive drums 22 of the respective process cartridges 13. Further, on the inner side of the intermediate transfer belt 28, primary transfer rollers 27 (27Y, 27M, 27C, and 27K) are disposed opposing to the photosensitive drums 22 with the intermediate transfer belt 28 therebetween. Then, electrostatic load bias is applied thereto by the primary transfer rollers 27, so that the toner images formed on the respective photosensitive drums 22 are transferred to the intermediate transfer belt 28 in an overlapped manner. As a result, a full color toner image is formed on the intermediate transfer belt 28.

Furthermore, a sheet feeding unit 15 including a feeding roller 20 for feeding a sheet P stored in a sheet cassette 21 is disposed on the lower portion of the printer main unit 11. Then, the sheet P stored in the sheet cassette 21 is conveyed to registration roller pair 16 by the feeding roller 20 of the sheet feeding unit 15.

Further, in FIG. 1, a secondary transfer unit 29*a* is configured of a secondary transfer roller 29 and the intermediate transfer belt 28. After the sheet P is conveyed to the registration roller pair 16, the sheet P is fed to the secondary transfer unit 29*a* by the registration roller pair 16 in synchronization with the toner image. The secondary transfer roller 29 is pressed against the intermediate transfer belt 28 by a contact pressure of 8 N/cm$^2$, so as to form a 4.0 mm transfer nip with the intermediate transfer belt 28. Further, secondary transfer bias is applied to the secondary transfer roller 29 from a power source (not illustrated).

In FIG. 1, toner cartridges 25 (25Y, 25M, 25C, and 25K), a pre-registration sensor 17, an intermediate conveyance guide 41, a fixing inlet guide 83, and a central processing unit (CPU) 200 are disposed in the printer main unit 11. The CPU 200 serves as a control unit for controlling an image forming operation and a sheet feeding operation. A fixing unit 80 includes a fixing roller 81 which includes a built-in heater as a heating unit and an elastic layer, and a pressure roller 82 which is pressed against the fixing roller 81 by a contact pressure of 30 N/cm$^2$. In addition, outer diameters of the fixing roller 81 and the pressure roller 82 are $\phi$30 respectively.

Next, the image forming operation of the color laser printer 10 configured as described above will be described. First, when image information is transmitted from a computer or a network such as a local area network (LAN) (not illustrated) connected to the printer main unit 11, the scanner units 24 emit laser light according to the image information. Then, surfaces of the photosensitive drums 22 uniformly charged with a predetermined polarity and potential by the charging units 23 are exposed to the laser light.

With this operation, the electric charge is removed from the exposed portions on the surfaces of the photosensitive drums 22, and electrostatic latent images are formed thereon. Then, the development units 26 develop the electrostatic latent images into toner images by applying toner thereto. With this operation, toner images in yellow, magenta, cyan, and black are respectively formed on photosensitive drums 22 of the process cartridges 13.

Next, a predetermined amount of pressure and electrostatic load bias are applied thereto by the primary transfer rollers 27, so that the toner images on the photosensitive drums 22 are transferred onto the intermediate transfer belt 28. The image forming operation of each process cartridge 13 will be executed at a timing in which one toner image is overlapped on a toner image of more upstream side primarily transferred to the intermediate transfer belt 28. As a result, a full color toner image is eventually formed on the intermediate transfer belt 28.

In synchronization with the above-described image forming operation, the sheet P is conveyed to the registration roller pair 16 from the sheet cassette 21 by the feeding roller 20 one-by-one. Thereafter, the sheet P is conveyed to the secondary transfer unit 29*a* by the registration roller pair 16. When the sheet P is pinched and conveyed through the secondary transfer unit 29*a*, a multicolor toner image formed on the intermediate transfer belt 28 is transferred onto the sheet P due to the bias applied to the secondary transfer roller 29. In addition, the secondary transfer roller 29 has an uniform straight-shape in which the outer diameter thereof is uniform in size, and thus the secondary transfer nip can maintain secondary transfer performance uniform in the width direction.

The sheet P that carries the multicolor toner image is introduced to an 8.0 mm heating nip formed of the fixing roller 81 and the pressure roller 82 of the fixing unit (fixing device) 80 while a leading end portion thereof is placed along the fixing inlet guide 83. Then, heat and pressure are applied at the heating nip, so that the toner image is fixed on a surface of the sheet P. In the fixing unit 80, in order to firmly press the sheet P while suppressing generation of creases, the fixing roller 81 has a straight-shape in which a size of the outer diameter is uniform in the width direction thereof, whereas the pressure roller 82 has an inverted crown-shape in which a size of the outer diameter from the central portion up to each end portion thereof is increasing by 0.15 mm.

As described above, by forming the outer diameter of the pressure roller 82 in the end portions to be larger than in the central portion, difference in driving speed of the sheet P arises in the heating nip, so that the sheet P is stretched toward the end portions from the central portion thereof, and thus the paper creases are less likely to be generated. Thereafter, the sheet P on which the toner image is fixed is discharged to a paper discharge tray 62 by a discharge roller pair 16.

In the present exemplary embodiment, when the sheet P is conveyed from the secondary transfer unit 29*a* to the fixing unit 80, after the leading end of the sheet P has reached the heating nip of the fixing unit 80, the sheet P is conveyed while forming a certain loop until the trailing end of the sheet P has passed through the secondary transfer unit 29*a*. Basically, in a state in which a certain loop is formed on the sheet P, the sheet P will not contact the intermediate conveyance guide 41 and the fixing inlet guide 83. However, if the loop of the sheet P becomes excessively large, there is a risk in which the sheet P contacts the intermediate belt cleaning unit 40.

Therefore, as illustrated in FIG. 1, a loop sensor 50 for detecting whether the loop amount is greater than a predetermined amount is disposed on the intermediate conveyance guide 41 which forms a sheet conveyance path R between the secondary transfer unit 29*a* and the fixing unit 80. The loop sensor 50 is configured of a sheet detection flag 51 and a light shielding flag 53 supported by a rotation shaft 52 in a rotatable manner, and a detection sensor 54 including a light sensor.

Then, if the sheet P forms a loop larger than a predetermined amount indicated by a dashed line, the sheet detection flag 51 contacts the non-printed surface of the sheet P, and the light shielding flag 53 rotates about the rotation shaft 52 to shield the detection sensor 54 from light. A signal of the detection sensor 54 is input to the CPU 200 illustrated in FIG. 2, so that the CPU 200 detects whether the loop amount of the sheet P becomes greater than the predetermined amount depending on whether the light shielding flag 53 shields the detection sensor 54 from light. Further, in the present exemplary embodiment, the CPU 200 processes a signal from the loop sensor 50 as ON when the detection sensor 54 is shielded from light, while processing the signal as OFF when the detection sensor 54 is not shielded from light. Hereinafter, in order to make the description simple, ON/OFF of the detection sensor 54 will be described as ON/OFF of the loop sensor 50.

Figure 2:
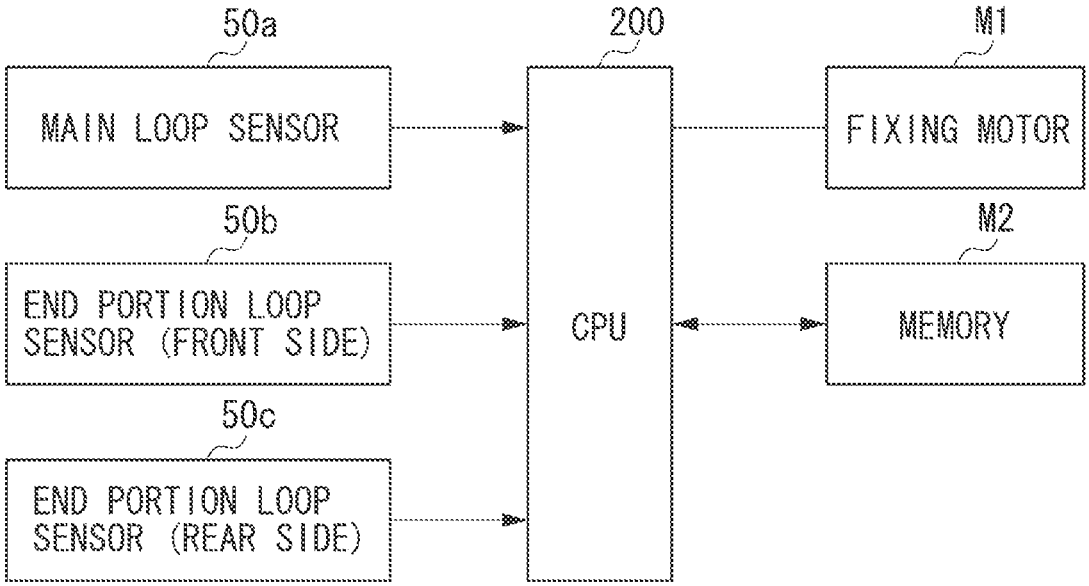
FIG. 2 is a control block diagram of the color laser printer.

As illustrated in FIG. 2, a main loop sensor 50*a*, an end portion loop sensor (front side) 50*b*, an end portion loop sensor (rear side) 50*c*, a memory M2, and a fixing motor M1 for driving the fixing roller 81, each of which is described below, are connected to the CPU 200. A level of a motor rotation speed F of the fixing motor M1 can be switched between three levels described below by the CPU 200 according to a detection result of the ON/OFF state of the loop sensor 50.

The rotation speed (sheet conveyance speed) of the fixing roller 81 can be switched by switching the rotation speed F of the fixing motor M1. With this configuration, the loop amount of the sheet P can be kept within a predetermined range. Herein, it is assumed that the sheet conveyance speed of the fixing unit 80 is V(F) whereas the sheet conveyance speed of the secondary transfer unit 29*a* is V(T). In the present exemplary embodiment, the sheet conveyance speed V(T) of the secondary transfer unit 29*a* is adjusted to 200 mm/sec.

Figure 3:
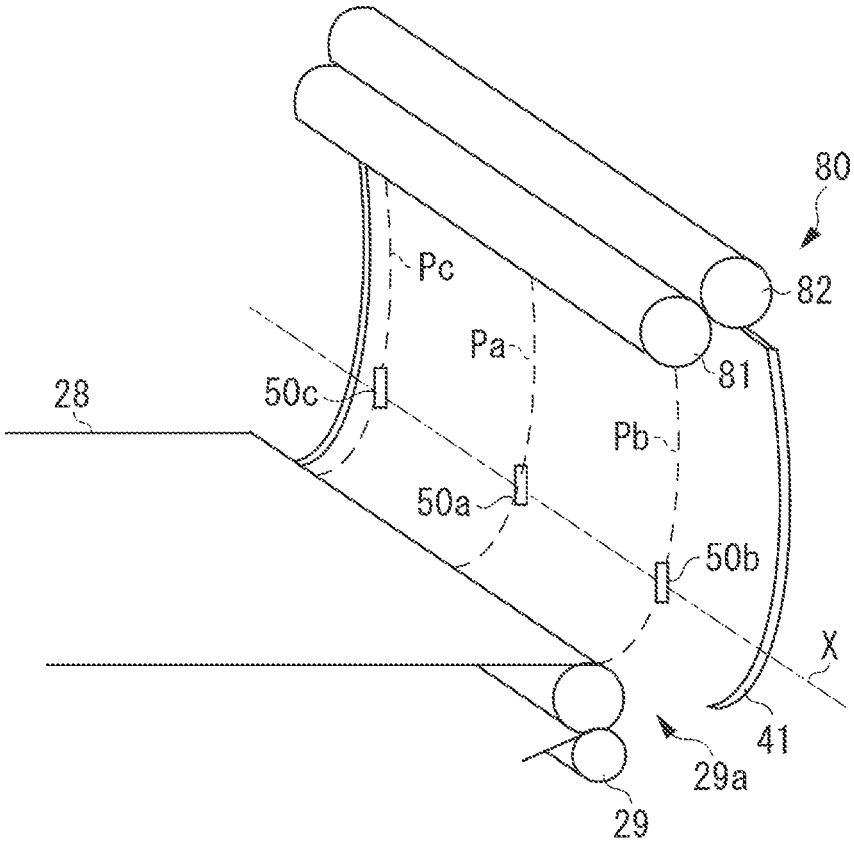
FIG. 3 is a diagram illustrating an arrangement of loop sensors in the color laser printer.

In the present exemplary embodiment, a plurality of the loop sensors 50 is disposed in a width direction indicated by a symbol X in FIG. 3. In other words, a main loop sensor 50*a* serving as a first detection unit is disposed on the central portion in the width direction orthogonal to the sheet conveyance direction of the sheet conveyance path R. Further, an end portion loop sensor (front side) 50*b* serving as a second detection unit is disposed on one side in the width direction of the sheet conveyance path R, whereas an end portion loop sensor (rear side) 50*c* serving as a third detection unit is disposed on another side in the width direction of the sheet conveyance path R.

The main loop sensor 50*a* is disposed in order to detect the overall loop amount of the sheet P, and outputs a signal according to the loop at the central portion in the width direction. In order to keep the loop amount of the sheet P within a predetermined range, the CPU 200 sets the rotation speed (hereinafter, referred to as "fixing motor rotation speed") F of the fixing motor M1 as F(L) when the main loop sensor 50*a* is an OFF state. By taking various conditions of the fixing unit 80 such as thermal expansion, durability, pressing force, and effect of variation in a roller diameter into consideration, the fixing motor rotation speed F(L) is set so that the sheet conveyance speed V(F) of the fixing unit 80 is always slower than the sheet conveyance speed V(T) of the secondary transfer unit 29*a*. Then, by setting the rotation speed of the fixing motor M1 as the above-described fixing motor rotation speed F(L), the fixing roller 81 rotates at the first sheet conveyance speed V(L) for increasing the loop amount.

On the other hand, when the main loop sensor 50*a* is an ON state, the CPU 200 sets the fixing motor rotation speed F as F(H). Herein, by taking the various conditions of the fixing unit 80 such as thermal expansion, durability, pressing force, and effect of variation in the roller diameter into consideration, the fixing motor rotation speed F(H) is set so that the sheet conveyance speed V(F) of the fixing unit 80 is always faster than the sheet conveyance speed V(T) of the secondary transfer unit 29*a*. Then, by setting the rotation speed of the fixing motor M1 as the fixing motor rotation speed F(H), the fixing roller 81 rotates at the second sheet conveyance speed V(H) for decreasing the loop, which is a speed faster than the first sheet conveyance speed V(L).

Next, relationship between the sheet conveyance speed V(T) of the secondary transfer unit 29*a* and the fixing motor rotation speed F will be described. Herein, the fixing motor rotation speed center value, when the sheet conveyance speed V(F) of the fixing unit 80 is approximately the same as the sheet conveyance speed V(T) of the secondary transfer unit 29*a*, is set as F(M). The following formulas 1 and 2 respectively express a relationship between the fixing motor rotation speed center value F(M) and a predetermined high speed fixing motor rotation speed F(H), and a relationship between the fixing motor rotation speed center value F(M) and a predetermined low speed fixing motor rotation speed F(L). In the present exemplary embodiment, F(M) is equal to 125.5 rpm.

$$F(H)=F(M)\times 1.03 \quad \text{Formula 1}$$

$$F(L)=F(M)\times 0.97 \quad \text{Formula 2}$$

In other words, as described above, because the fixing motor rotation speed F is F(L) when the main loop sensor 50*a* is in the OFF state, the sheet conveyance speed V(F) of the fixing unit 80 is slower than the sheet conveyance speed V(T) of the secondary transfer unit 29*a*. As a result, after the leading end of the sheet P has reached the heating nip of the fixing unit 80, the loop amount of the sheet P is increased. When the loop amount is greater than a predetermined amount, the main loop sensor 50*a* becomes the ON state.

As described above, because the fixing motor rotation speed F is F(H) when the main loop sensor 50*a* is in the ON state, the sheet conveyance speed V(F) of the fixing unit 80 is faster than the sheet conveyance speed V(T) of the secondary transfer unit 29*a*. As a result, the loop amount of the sheet P is decreased, so that the main loop sensor 50*a* eventually becomes the OFF state. In the present exemplary embodiment, when the main loop sensor 50*a* is in the OFF state, the loop amount of the sheet P is increased by setting the fixing motor rotation speed F as F(L).

In this manner, the loop amount of the sheet P can be kept within a predetermined range which does not exceed a predetermined amount by repeatedly increasing and decreasing the fixing motor rotation speed F according to the ON/OFF state of the main loop sensor 50*a*. In other words, a certain amount of loop can be formed by the CPU 200 feeding back a signal from the main loop sensor 50*a* to the fixing motor rotation speed F. Through the loop control employing the main loop sensor 50*a*, for example, even if the fixing roller 81 is thermally expanded or the outer diameter thereof slightly varies in size, the loop amount of the sheet P can be kept within a predetermined range which does not exceed a predetermined amount without depending on the fixing roller 81.

Figure 4A:
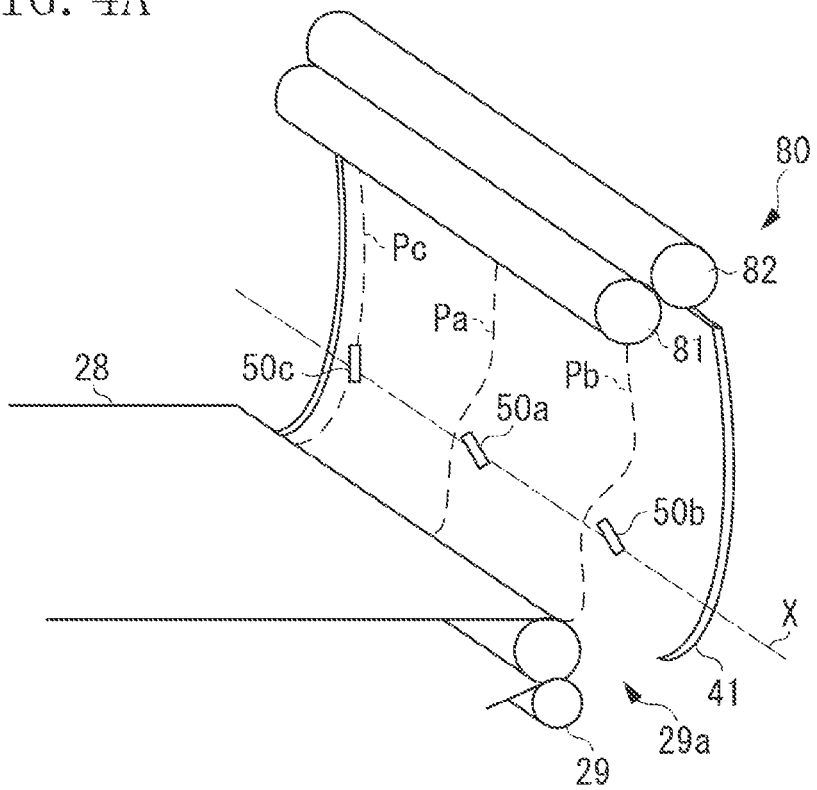
FIGS. 4A and 4B are diagrams illustrating a state in which a lopsided loop has been generated in the color laser printer.

When the sheet P is conveyed in an unstable state, as illustrated in FIG. 4A, the sheet P may loop while warping in the width direction. In this case, a loop shape Pa at the sheet central portion, a loop shape Pb at the sheet end portion (front side), and a loop shape Pc at the sheet end portion (rear side) are different from each other. The state of the sheet P described above is referred to as a lopsided looped state, and such a loop shape of the sheet P is referred to as a lopsided loop shape.

Based on the signal from the end portion loop sensor 50*b*, the CPU 200 detects that the loop amount of the sheet P at the detection position of the end portion loop sensor 50*b* becomes greater than a predetermined amount. Based on the signal from the end portion loop sensor 50*c*, the CPU 200 detects that the loop amount of the sheet P at the detection position of the end portion loop sensor 50*c* becomes greater than a predetermined amount. The CPU 200 detects whether the lopsided loop has been generated in the sheet P based on the signals from the end portion loop sensors 50*b* and 50*c*. The CPU 200 configures a lopsided loop detection unit for detecting a lopsided loop of the sheet P together with the end portion loop sensors 50*b* and 50*c*. Then, in a case where the CPU 200 detects the lopsided loop of the sheet P based on the signals from the end portion loop sensors 50*b* and 50*c*, the CPU 200 executes loop control based on the signals from the end portion loop sensors 50*b* and 50*c*.

For example, when the sheet P lopsidedly loops as illustrated in FIG. 4A, the main loop sensor 50*a* and the end portion loop sensor (front side) 50*b* are OFF while the end portion loop sensor (rear side) 50*c* is ON. In other words, when the sheet P loops lopsidedly, the signals of the end portion loop sensor (front side) 50*b* and the end portion loop sensor (rear side) 50*c* are different from each other. Then, when the signals of the end portion loop sensor (front side) 50*b* and the end portion loop sensor (rear side) 50*c* are different from each other, the CPU 200 determines that the sheet P has looped lopsidedly.

Figure 4B:
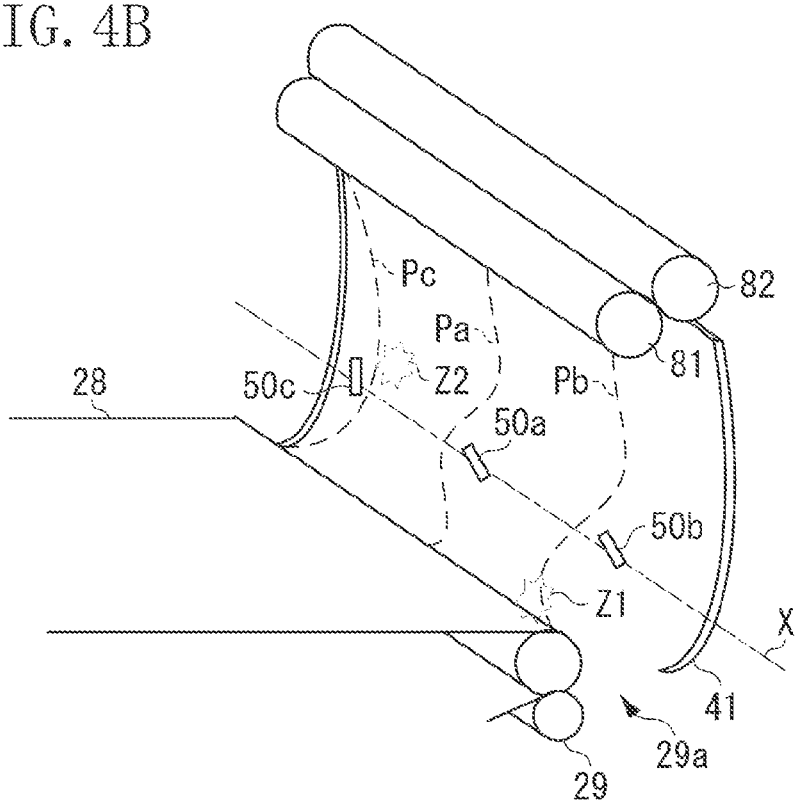

Here, if the loop control is executed by only using a signal from the main loop sensor 50*a*, the loop control becomes unstable because the sheet P has looped lopsidedly. For example, even in the case where the main loop sensor 50*a* is OFF caused by the lopsided loop of the sheet P, the CPU 200 slows down the sheet conveyance speed of the fixing unit 80 according to the OFF state of the main loop sensor 50*a*. However, even if the CPU 200 slows down the sheet conveyance speed, the OFF state of the main loop sensor 50*a* may be continued because of the lopsided loop. In such a case, the sheet conveyance speed of the fixing unit 80 remains slow until the main loop sensor 50*a* is ON, and thus the loop of the sheet P becomes excessively large. As a result, as illustrated in FIG. 4B, the sheet P is scraped against the above-described intermediate transfer belt cleaning unit 40 illustrated in FIG. 1 at a position Z1, or strongly makes contact with the intermediate conveyance guide 41 at a position Z2, and thus defective images or paper creases may be generated.

Therefore, in the present exemplary embodiment, in a case where the CPU 200 detects the lopsided loop based on signals from the end portion loop sensors 50*b* and 50*c*, the CPU 200 feeds back the detection result to the fixing motor rotation speed F. When the lopsided loop has been generated in the sheet P, the CPU 200 changes the fixing motor rotation speed F in order to convey the sheet P stably. In the present exemplary embodiment, when the signals of the end portion loop sensors 50*b* and 50*c* are different from each other (i.e., ON/OFF or OFF/ON) for a predetermined period of time such as 100 msec or more, for example, the CPU 200 determines that the sheet P is a lopsidedly looped state.

Then, if the CPU 200 determines that the sheet P is in the lopsidedly looped state, the CPU 200 sets the fixing motor rotation speed F as F(MH) regardless of the detection result of the main loop sensor 50*a*. Further, the relationship between the fixing motor rotation speed F(MH) and the above described rotation speed center value F(M) of the fixing motor M1 is expressed by the following formula 3.

$$F(MH)=F(M)\times 1.01 \quad \text{Formula 3}$$

Therefore, in the present exemplary embodiment, the fixing motor rotation speed F(MH) is set within a switching speed range of the main loop sensor 50*a*, i.e., high speed fixing motor rotation speed F(H)>fixing motor rotation speed F(MH)>low speed fixing motor rotation speed F(L). In other words, when the lopsided loop has generated, the rotation speed of the fixing roller 81 is set to a predetermined sheet conveyance speed approximate to a central speed of the fixing roller 81, which is a speed intermediate between the sheet conveyance speeds V(F) and V(L).

When the fixing motor rotation speed F(MH) is set as described above, the loop of the sheet P is decreased. However, because the decreasing speed thereof is slower than the sheet conveyance speed V(L), the sheet P can be prevented from being scraped against the intermediate transfer belt cleaning unit 40 or strongly making contact with the intermediate conveyance guide 41. Furthermore, when the loop of the sheet P is decreased, one of the signals of the end portion loop sensors 50*b* and 50*c* changes from ON to OFF accordingly, so that the signals of the two end portion loop sensors 50*b* and

50*c* will be equal to each other. Then, when the signals of the two end portion loop sensors 50*b* and 50*c* are equal to each other, the CPU 200 executes the loop amount control according to the signal of the main loop sensor 50*a*.

For example, if the main loop sensor 50*a* is OFF when the signals of the end portion loop sensors 50*b* and 50*c* becomes equal to each other, the CPU 200 increases the loop amount of the sheet P by setting the fixing motor rotation speed as the low speed fixing motor rotation speed F(L). Further, in a case where the main loop sensor 50*a* is ON, the CPU 200 can prevent the loop amount of the sheet P from increasing excessively by setting the fixing motor rotation speed as the high speed fixing motor rotation speed F(H). As described above, when the lopsided loop has been generated, the loop amount of the sheet P in the lopsided looped state can be prevented from increasing excessively by setting the fixing roller rotation speed F as F(MH) regardless of the ON/OFF state of the main loop sensor 50*a*.

Figure 5:
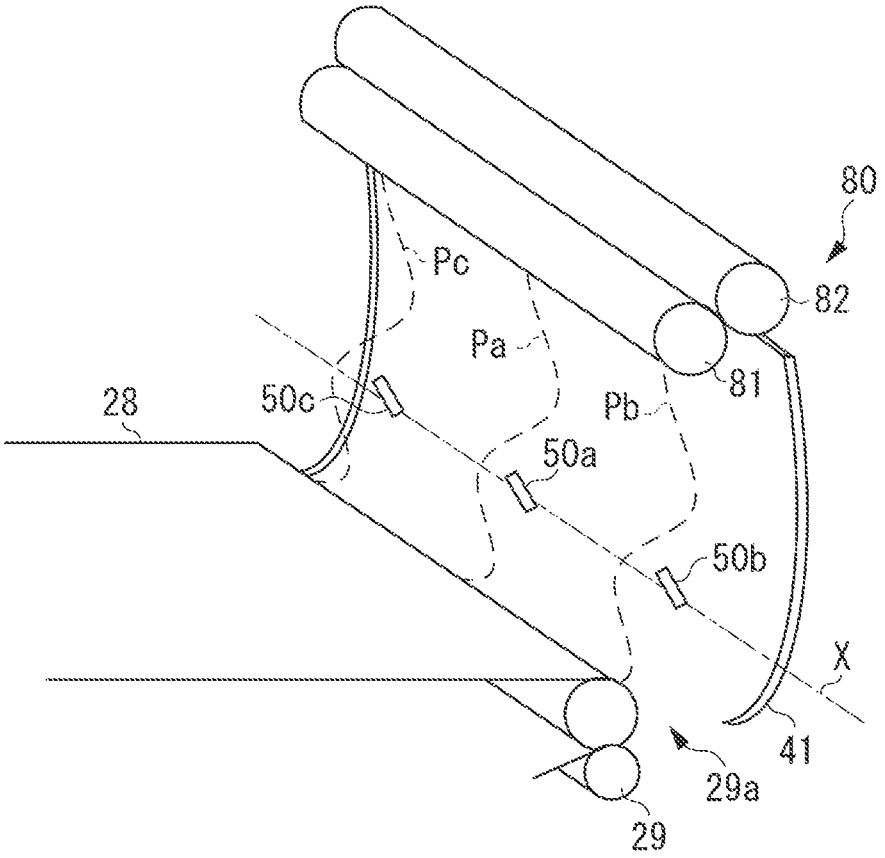
FIG. 5 is a diagram illustrating a state in which an inverted loop has been generated in the color laser printer.

Further, as illustrated in FIG. 5, if the loop amount is increased when the lopsided loop has been generated, there is a risk of forming an inverted loop in which the loop is formed opposite to the original design of the loop shape. In a case where the sheet P forms the inverted loop, the loop amount cannot be controlled by any of the loop sensors. Therefore, in the present exemplary embodiment, in order to prevent the loop amount from being increased, the fixing roller rotation speed F(MH) is set to be greater than the fixing motor rotation speed center value F(M) of the fixing roller 81. In other words, the inverted loop is suppressed by setting the fixing roller rotation speed as F(MH)>F(M).

Figure 6:
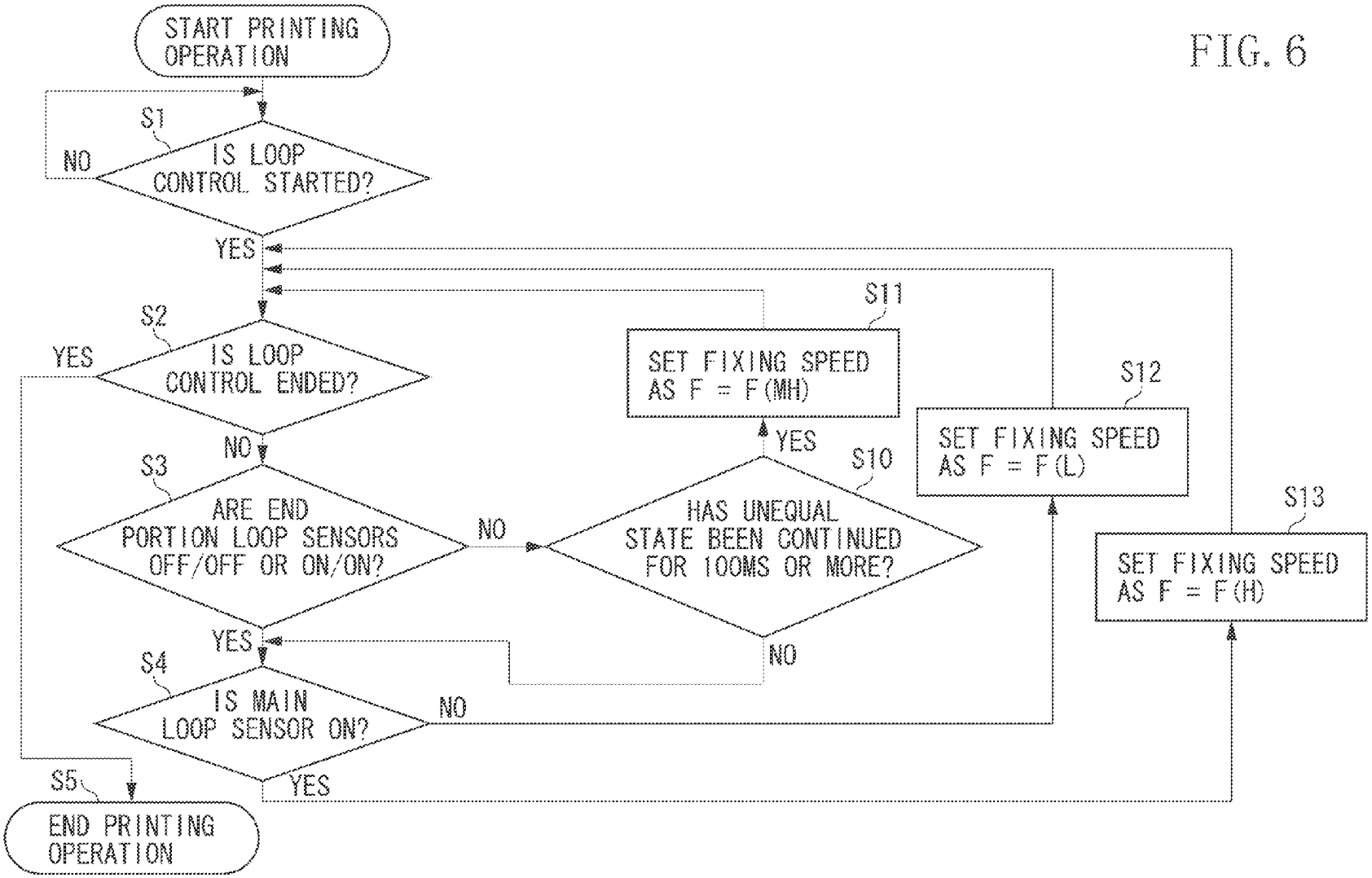
FIG. 6 is a flowchart illustrating driving speed control of a fixing roller of the color laser printer.

Next, driving speed control of the fixing roller 81 in a printing period using the main loop sensor 50*a*, the end portion loop sensors 50*b* and 50*c* according to the present exemplary embodiment will be described with reference to the flowchart illustrated in FIG. 6.

The CPU 200 starts a printing operation upon receiving a printing job. In step S1, at the timing at which the leading end of the sheet P enters the fixing unit 80, the CPU 200 determines to start the loop control (YES in step S1). Until the loop control is ended (NO in step S2), the processing to step S3. The CPU 200 ends the loop control at a timing at which the trailing end of the sheet P has passed through the secondary transfer unit 29*a*. In step S3, the CPU 200 determines whether the signals of the end portion loop sensors 50*b* and 50*c* are equal to each other (i.e., ON/ON or OFF/OFF).

If the signals of the end portion loop sensors 50*b* and 50*c* are not equal to each other (NO in step S3), the processing proceeds to step S10. In step S10, if such an unequal state of the signals has been continued for 100 msec or more (YES in step S10), the processing proceeds to step S11. In step S11, the CPU 200 sets the fixing motor rotation speed (fixing speed) F as F(MH). If the signals of the end portion loop sensors 50*b* and 50*c* are equal to each other (YES in step S3), or the unequal state of the signals has not been continued for 100 msec (NO in step S10), the processing proceeds to step S4. In step S4, the CPU 200 determines whether the main loop sensor 50*a* is ON.

If the main loop sensor 50*a* is not ON (NO in step S4), the processing proceeds to step S12. In step S12, the CPU 200 sets the fixing motor rotation speed F as F(L). If the main loop sensor 50*a* is ON (YES in step S4), the processing proceeds to step S13. In step S13, the CPU 200 sets the fixing motor rotation speed F as F(H). In addition, in step S2, at the timing at which the trailing end of the sheet P has passed through the secondary transfer unit 29*a* and the loop control is ended (YES in step S2), the processing proceeds to step S5. In step S5, the CPU 200 ends the printing job.

Figure 7A:
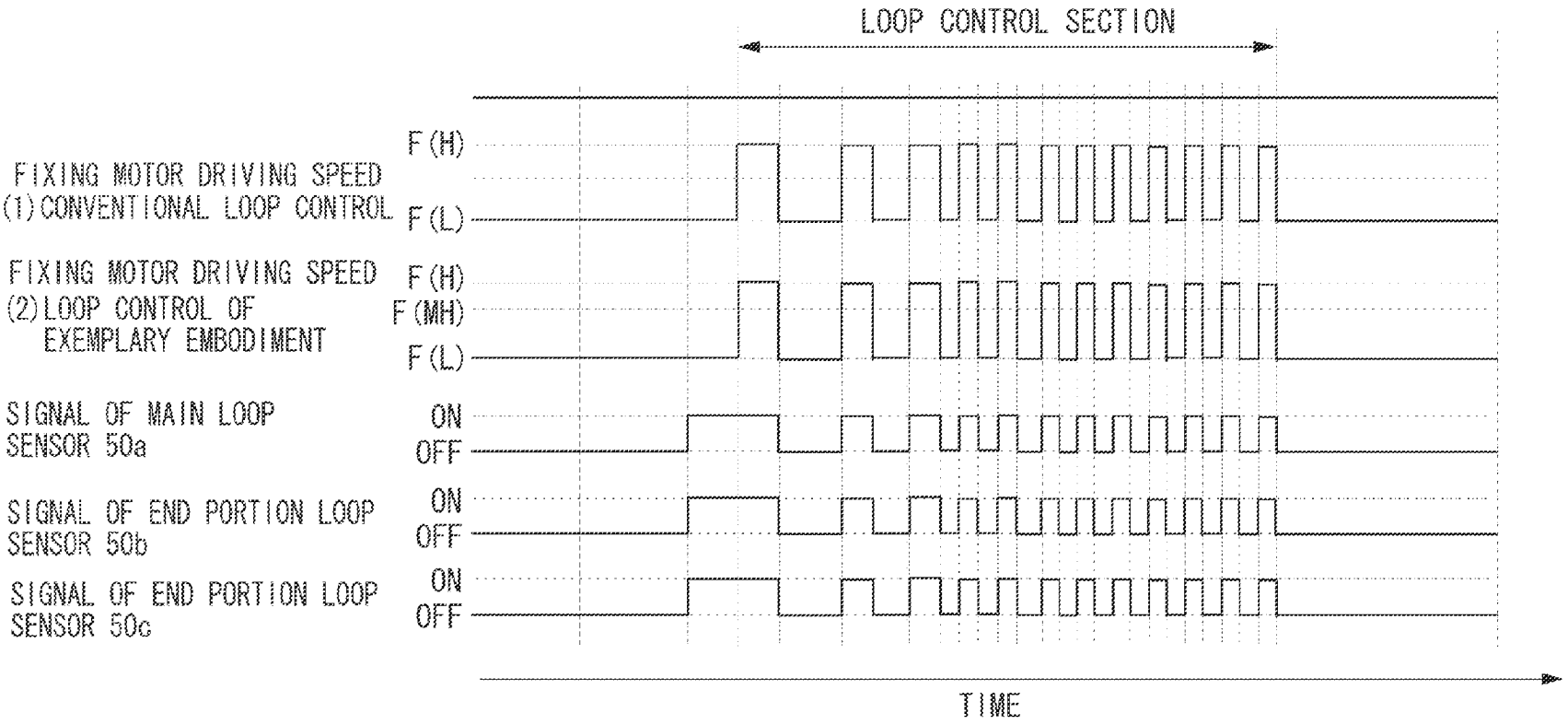
FIGS. 7A and 7B are sequence diagrams illustrating driving speed control of the color laser printer.
Figure 7B:
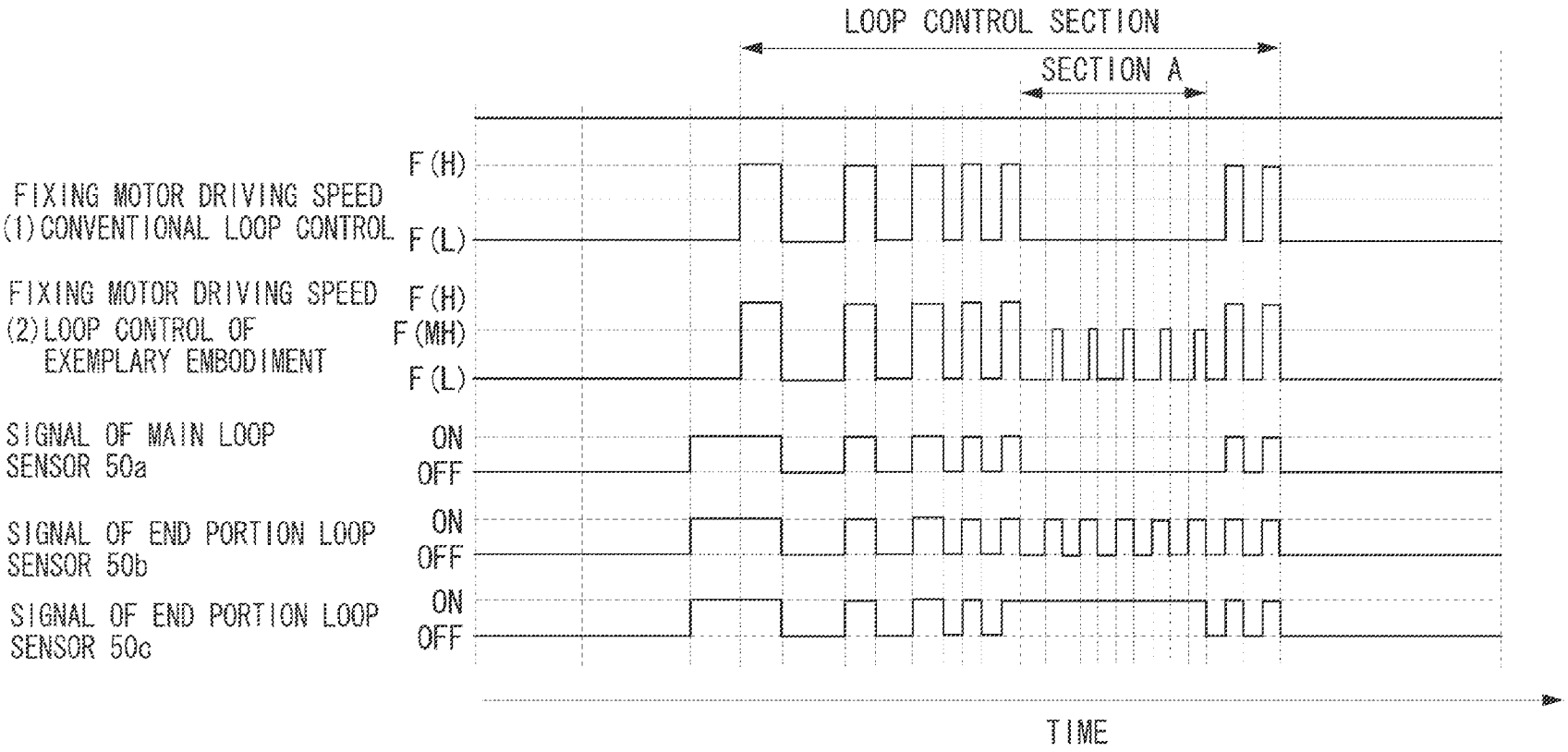

Next, the effect of the present exemplary embodiment will be described by taking the conventional loop control as a comparison example. FIG. 7A is a sequence diagram illustrating the loop control for a non-lopsided looped state, whereas FIG. 7B is a sequence diagram illustrating the loop control for a lopsided looped state. FIGS. 7A and 7B illustrate a relationship between detection results of the respective loop sensors and fixing motor driving speed by the conventional loop control (1) only using the main loop sensor 50*a* and (2) the loop control according to the present exemplary embodiment. Further, as for the conventional loop control (1) only using the main loop sensor 50*a*, the loop control without executing the processing in step S3 in FIG. 5 will be described as an example thereof.

As illustrated in FIG. 7A, in the non-lopsided looped state, there is no difference between the loop controls of (1) and (2) because the lopsided loop is not detected in step S3. Therefore, in both the loop controls (1) and (2), the CPU 200 switches the fixing motor rotation speed between F(L) and F(H) according to the ON/OFF state of the main loop sensor 50*a*.

On the other hand, in the lopsided looped state, as illustrated in FIG. 7B, the CPU 200 executes the loop detection by only using the main loop sensor 50*a* in the conventional loop control (1). Therefore, in a case where the lopsided loop has been generated in the sheet P, and the sheet P comes into a state described in FIG. 4A, for example, the OFF state of the main loop sensor 50*a* will be continued as illustrated in a section A illustrated in FIG. 7B. In this period, the loop amount is increased because the fixing motor rotation speed (fixing speed) F is continuously set as F(L).

However, because the sheet P has looped lopsidedly, even if the loop amount is increased in this way and becomes greater than a predetermined loop amount, the main loop sensor 50*a* cannot detect the loop formed on the sheet P. Accordingly, as illustrated in FIG. 4B, the sheet P is scraped against the intermediate transfer belt cleaning unit 40 or strongly contacts the intermediate conveyance guide 41 until the main loop sensor 50*a* detects the loop of the sheet P.

On the other hand, in the loop control according to the present exemplary embodiment (2) illustrated in FIG. 7B, the CPU 200 changes the fixing motor rotation speed to F(MH) when the CPU 200 detects the lopsided loop of the sheet P based on the signals from the end portion loop sensors 50*b* and 50*c*. When the CPU 200 changes the fixing motor rotation speed to F(MH), the loop amount is decreased gradually. Then, when the signals of the end portion loop sensors 50*b* and 50*c* become equal to each other as described above, the CPU 200 executes the loop amount control according to the signal of the main loop sensor 50*a*.

The Table 1 illustrated below indicates incidence ratios of defective images and paper creases caused by conveyance failure of the sheet P in the conventional loop control (1) and the loop control according to the present exemplary embodiment (2) described in FIG. 7B. In Table 1, the incidence ratios are acquired based on the following conditions: 30° C. and 80% as a temperature and humidity condition of the evaluation room, GFR070-A3 size recycled paper (Canon recycled paper) as a sheet condition, 100% black whole-surface printed image as a printing image condition, and 40 sheets as a condition of sheet-passing number.

TABLE 1

| | Incidence Ratio of Scraped Image | Incidence Ratio of Paper Crease |
|---|---|---|
| (1) Conventional Loop Control | 6/40 | 3/40 |
| (2) Loop Control of the First Exemplary Embodiment | 1/40 | 1/40 |

As illustrated in Table 1, the incidence ratio of scraped images caused by the sheet contacting the intermediate transfer belt cleaning unit 40 or the fixing roller 81, and the incidence ratio of paper creases are lower in the loop control of the first exemplary embodiment (2) than in the conventional loop control (1).

As described above, according to the present exemplary embodiment, in a case where the signals of the end portion loop sensors 50*b* and 50*c* are not equal, the CPU 200 determines that the lopsided loop has been generated in the sheet P and executes a second speed control for setting the fixing motor rotation speed as F(MH). Thereafter, when the signals of the end portion loop sensors 50*b* and 50*c* become equal, the CPU 200 executes a first speed control for setting the fixing motor rotation speed as F(L) or F(H) according to the signal (ON or OFF) of the main loop sensor 50*a*. By repeatedly executing the first and the second speed controls, the loop amount can be kept within a predetermined range which does not exceed a predetermined amount even if the lopsided loop is generated therein.

With this operation, even if the lopsided loop is generated, the sheet P can be conveyed without increasing the loop amount excessively, and thus the defective images or the paper creases caused by excessive increase in the loop amount of the sheet P can be reduced. In other words, in the present exemplary embodiment, the CPU 200 detects presence and absence of the lopsided loop of the sheet P, and in addition, when the lopsided loop has been generated, the CPU 200 controls the sheet conveyance speed of the fixing unit 80 according to the signals from the end portion loop sensors 50*b* and 50*c*. In this way, the sheet P can be stably conveyed even in the lopsided looped state, and thus the defective images or the paper creases caused by the conveyance failure arising in the lopsided looped state can be reduced.

In addition, in the present exemplary embodiment, when the lopsided loop has been generated, the fixing motor rotation speed F in the lopsided loop detection period is set as F(MH)>F(M) in order to make the speed of the sheet P approximate to the central speed of the roller. However, there may be a case in which a configuration of the image forming apparatus main unit, arrangement of the loop sensors, and a loop shape to be formed are different from those described in the present exemplary embodiment. In this case, the fixing motor rotation speed may be set as F(MH)<F(M) in order to make the signals of the end portion loop sensors 50*b* and 50*c* in different states be equal to each other. Further, in a case where the lopsided loop has been generated, the fixing motor rotation speed can be set as F(MH)=F(M) in order to prevent the loop amount from being increased excessively.

Description has been given of the configuration in which the main loop sensor 50*a*, the end portion loop sensors 50*b* and 50*c* are arranged in a width direction. However, the present invention is not limited thereto. The end portion loop sensors 50*b* and 50*c* may be disposed in a shifted manner from the main loop sensor 50*a* in the sheet conveyance direction.

Figure 8:
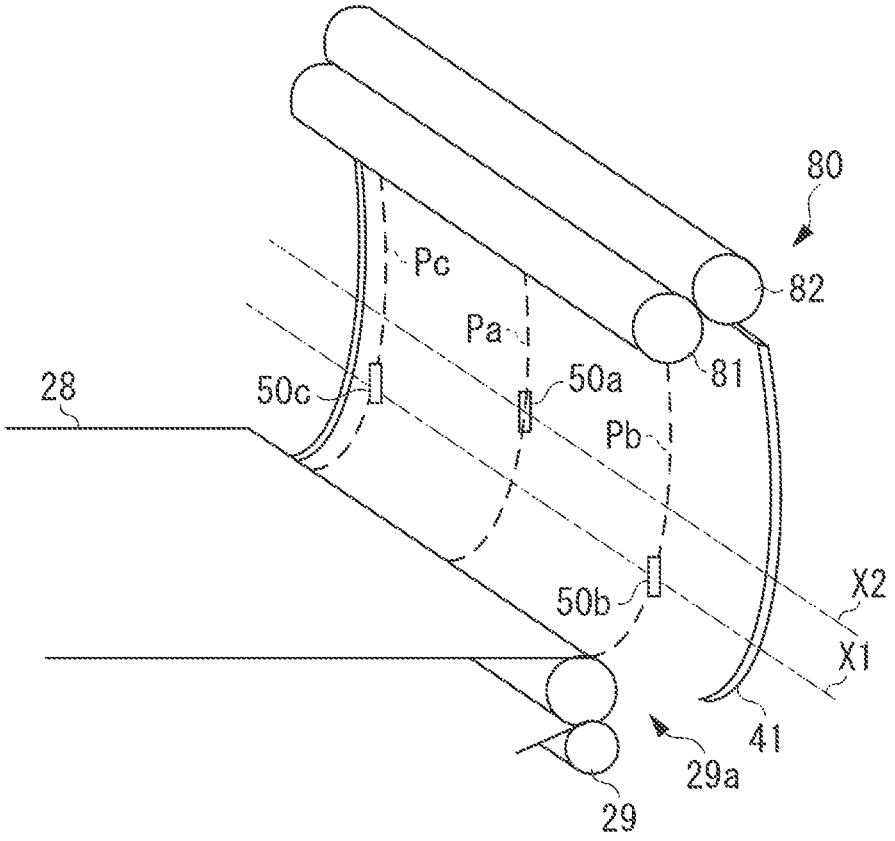
FIG. 8 is a diagram illustrating an arrangement of loop sensors in the image forming apparatus according to a second exemplary embodiment.

Next, description will be given of a second exemplary embodiment of the present invention in which the end portion loop sensors 50*b* and 50*c* are disposed in a shifted manner from the main loop sensor 50*a* in the sheet conveyance direction. FIG. 8 is a diagram illustrating an arrangement of the loop sensors of the image forming apparatus according to the present exemplary embodiment. Further, in FIG. 8, the same reference numerals as in FIG. 3 are assigned to the portions which are the similar to or corresponding to those illustrated in FIG. 3.

Figure 9:
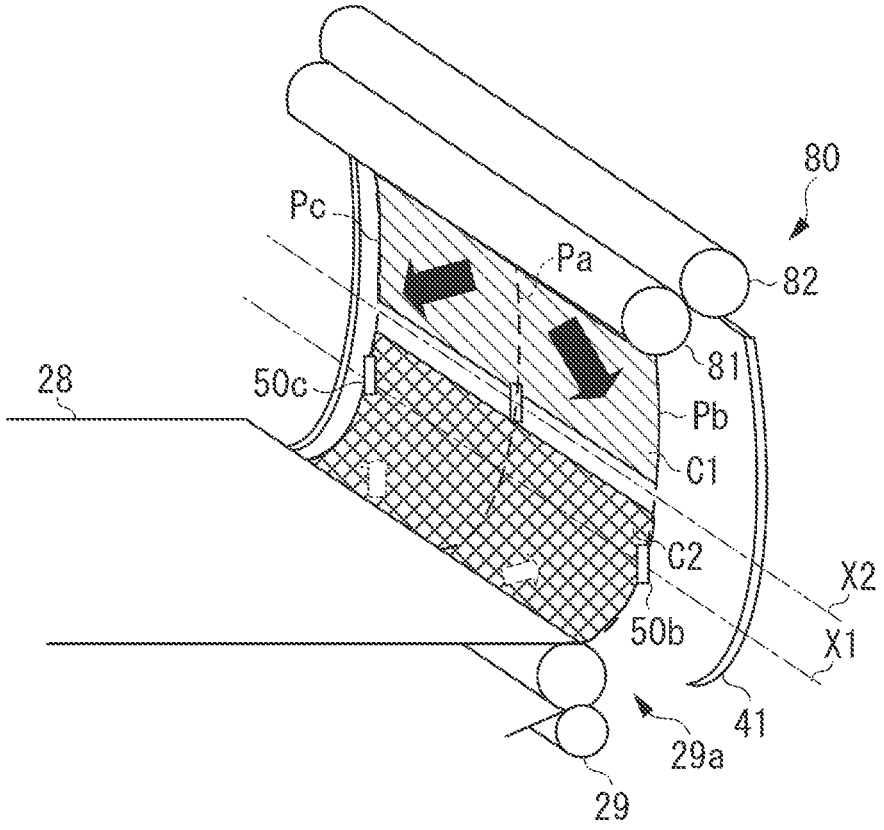
FIG. 9 is a schematic diagram illustrating magnitude of tension applied to a sheet in the image forming apparatus.

As illustrated in FIG. 8, in the present exemplary embodiment, the main loop sensor 50*a* is disposed at the central portion in the width direction indicated by a symbol X2, whereas the end portion loop sensors 50*b* and 50*c* are disposed on the upstream side of the main loop sensor 50*a* in the sheet conveyance direction indicated by a symbol X1. As described above, in order to suppress the creases from being generated on the sheet P at the fixing unit 80, the pressure roller 82 has an inverted crown-shape in a longitudinal outer diameter thereof. Therefore, in the vicinity of the fixing unit 80, the sheet P is stretched in the width direction. As a result, in a region C1 that is the vicinity of the fixing unit 80 illustrated in FIG. 9, a strong tension is applied to the sheet P at the central portion in the width direction toward the end portions thereof, so that the behavior of the sheet P becomes stable.

On the other hand, in a region C2 that is located in the vicinity of the secondary transfer unit 29*a*, the sheet P is away from the fixing unit 80, so that tension of the fixing unit 80 is less likely to be applied thereto. In addition, the secondary transfer unit 29*a* applies almost no tension to the sheet P in the width direction, so that behavior of the sheet P becomes unstable. As a result, the lopsided loop of the sheet P is likely to be generated in the vicinity of the secondary transfer unit 29*a*.

Therefore, in the present exemplary embodiment, the end portion loop sensors 50*b* and 50*c* are disposed closer to the secondary transfer unit 29*a*. Furthermore, accuracy of the loop control can be improved if the main loop sensor 50*a* which detects the overall loop amount of the sheet P executes the detection operation in the vicinity of a loop portion of the sheet P with the maximum loop amount. Therefore, stable loop control and stable conveyance of the sheet P can be realized if the end portion loop sensors 50*b* and 50*c* are disposed on the upstream side of the main loop sensor 50*a* in the sheet conveyance direction.

The Table 2 illustrated below indicates the incidence ratios of defective images and paper creases caused by conveyance failure of the sheet P. Table 2 illustrates the incidence ratios in (1) the conventional loop control illustrated in FIG. 7B and (2) the loop control at the loop sensor positions according to the first exemplary embodiment illustrated in FIG. 7B. Further, Table 2 also illustrates the incidence ratios in (3) the loop control at the loop sensor positions according to the present exemplary embodiment.

TABLE 2

| | Incidence Ratio of Scraped Image | Incidence Ratio of Paper Crease |
|---|---|---|
| (1) Conventional Loop Control | 6/40 | 3/40 |
| (2) Loop Control of the First Exemplary Embodiment | 1/40 | 1/40 |
| (3) Loop Control of the Second Exemplary Embodiment | 0/40 | 0/40 |

As illustrated in Table 2, the loop control at the loop sensor positions according to the present exemplary embodiment can suppress the occurrence of scraped images and paper creases more than the loop control at the loop sensor positions according to the first exemplary embodiment.

As described above, according to the present exemplary embodiment, the end portion loop sensors 50*b* and 50*c* are disposed on the upstream side of the main loop sensor 50*a* in the sheet conveyance direction. With this configuration, the main loop sensor 50*a* can stably detect a loop shape of the entire sheet P at the position with the maximum loop amount, whereas the end portion loop sensors 50*b* and 50*c* can detect occurrence of the lopsided loop at the positions closer to the secondary transfer unit 29*a*. Therefore, the same effect as in the above-described first exemplary embodiment can be acquired thereby. Accordingly, it is preferable that the loop sensors be disposed in the similar manner as described in the present exemplary embodiment if a configuration of the image forming apparatus has flexibility in the alignment of the loop sensors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-092116 filed Apr. 25, 2013, which is hereby incorporated by reference herein in its entirety.

What is claimed is:

1. An image forming apparatus comprising:

a transfer unit configured to transfer a toner image onto a sheet;

a fixing unit configured to fix the toner image transferred onto the sheet by the transfer unit;

a sheet conveyance path disposed between the transfer unit and the fixing unit;

a first detection unit configured to generate a signal according to a loop of the sheet at a central portion in a width direction orthogonal to a sheet conveyance direction of the sheet conveyance path;

a second detection unit configured to generate a signal according to a loop of the sheet on one side of the sheet in the width direction of the sheet conveyance path;

a third detection unit configured to generate a signal according to a loop of the sheet on another side of the sheet in the width direction of the sheet conveyance path; and a control unit configured to control a sheet conveyance speed at the fixing unit based on signals from the first detection unit, the second detection unit, and the third detection unit, wherein the control unit switches the sheet conveyance speed at the fixing unit to either a first sheet conveyance speed or a second sheet conveyance speed that is faster than the first sheet conveyance speed based on a signal from the first detection unit in a case where the control unit detects that both a loop amount of a loop of the sheet at a detection position of the second detection unit and a loop amount of a loop of the sheet at a detection position of the third detection unit are greater than a predetermined amount, or in a case where the control unit detects that both the loop amount of the loop of the sheet at the detection position of the second detection unit and the loop amount of the loop of the sheet at the detection position of the third detection unit are less than the predetermined amount, based on the signals from the second detection unit and the third detection unit, and wherein the control unit sets the sheet conveyance speed at the fixing unit as a predetermined sheet conveyance speed between the first sheet conveyance speed and the second sheet conveyance speed in a case where the control unit detects that one of the loop amounts of the sheet at detection positions of the second detection unit and the third detection unit is greater than the predetermined amount based on the signal from the one of the second detection unit and the third detection unit when the other of the loop amounts of the sheet at detection positions of the second detection unit and the third detection unit is less than the predetermined amount based on the signal from the another one of the second detection unit and the third detection unit.

2. The image forming apparatus according to claim 1, wherein the control unit switches the sheet conveyance speed at the fixing unit to the predetermined sheet conveyance speed in a case where a state in which the control unit detects that one of loop amounts of the sheet at detection positions of the second detection unit and the third detection unit is greater than the predetermined amount based on the signal from the one of the second detection unit and the third detection unit and another one of loop amounts of the sheet at detection positions of the second detection unit and the third detection unit detects is less than the predetermined amount based on the signal from the another detection unit has been continued for a predetermined period of time.

3. The image forming apparatus according to claim 1, wherein the predetermined sheet conveyance speed is a speed approximately intermediate between the first sheet conveyance speed and the second sheet conveyance speed.

4. The image forming apparatus according to claim 1, wherein loop detection positions of the second detection unit and the third detection unit are upstream of a loop detection position of the first detection unit in a sheet conveyance direction.

5. An image forming apparatus comprising:

a transfer unit configured to transfer a toner image formed by an image forming unit onto a sheet;

a fixing unit configured to fix the toner image transferred onto the sheet by the transfer unit;

a sheet conveyance path disposed between the transfer unit and the fixing unit;

a loop detection unit configured to generate a signal according to a loop of the sheet in the sheet conveyance path;

a lopsided loop detection unit configured to detect whether a state of the sheet is a lopsided looped state in which only one loop amount of one side of the sheet in a width direction of the sheet conveyance path and another side of the sheet in the width direction of the sheet conveyance path becomes greater than a predetermined amount; and a control unit configured to switch the sheet conveyance speed at the fixing unit to either a first sheet conveyance speed or a second sheet conveyance speed that is faster than the first sheet conveyance speed based on a signal from the loop detection unit in a case where the lopsided loop detection unit does not detect that the state of the sheet is the lopsided looped state, wherein the control unit further is configured to configured to set the sheet conveyance speed at the fixing unit as a predetermined sheet conveyance speed between the first sheet conveyance speed and the second sheet conveyance speed in a case where the lopsided loop detection unit detects that the state of the sheet is the lopsided looped state.

6. The image forming apparatus according to claim 5, wherein the control unit switches the sheet conveyance speed at the fixing unit to the predetermined sheet conveyance speed in a case where a state in which the lopsided loop detection unit detects a lopsided loop has been continued for a predetermined period of time.

7. The image forming apparatus according to claim 5, wherein the predetermined sheet conveyance speed is a speed intermediate between the first sheet conveyance speed and the second sheet conveyance speed.

8. The image forming apparatus according to claim 5, wherein the lopsided loop detection unit detects a loop of the sheet on an upstream side of the detection position of the loop detection unit in a sheet conveyance direction.

9. The image forming apparatus according to claim 5, wherein the lopsided loop detection unit includes a second detection unit configured to generate a signal according to a loop of the sheet on one side in the width direction of the sheet conveyance path, and a third detection unit configured to generate a signal according to a loop of the sheet on another side in the width direction of the sheet conveyance path.

10. A sheet conveyance method for an image forming apparatus having a transfer unit configured to transfer a toner image onto a sheet, a fixing unit configured to fix the toner image transferred onto the sheet by the transfer unit, and a sheet conveyance path disposed between the transfer unit and the fixing unit, the sheet conveyance method comprising:

generating, as a first detection, a signal according to a loop of the sheet at a central portion in a width direction orthogonal to a sheet conveyance direction of the sheet conveyance path;

generating, as a second detection, a signal according to a loop of the sheet on one side of the sheet in the width direction of the sheet conveyance path;

generating, as a third detection, a signal according to a loop of the sheet on another side of the sheet in the width direction of the sheet conveyance path; and controlling a sheet conveyance speed at the fixing unit based on signals from the first detection, the second detection, and the third detection, wherein controlling includes switching the sheet conveyance speed at the fixing unit to either a first sheet conveyance speed or a second sheet conveyance speed that is faster than the first sheet conveyance speed based on a signal from the first detection in a case where controlling includes detecting that both a loop amount of a loop of the sheet at a detection position of the second detection and a loop amount of a loop of the sheet at a detection position of the third detection are greater than a predetermined amount, or in a case where controlling includes detecting that both the loop amount of the loop of the sheet at the detection position of the second detection and the loop amount of the loop of the sheet at the detection position of the third detection are less than the predetermined amount, based on the signals from the second detection and the third detection, and wherein controlling includes setting the sheet conveyance speed at the fixing unit as a predetermined sheet conveyance speed between the first sheet conveyance speed and the second sheet conveyance speed in a case where controlling includes detecting that one of the loop amounts of the sheet at detection positions of the second detection and the third detection is greater than the predetermined amount based on the signal from the one of the second detection and the third detection when the other of the loop amounts of the sheet at detection positions of the second detection and the third detection is less than the predetermined amount based on the signal from the another one of the second detection and the third detection.

11. The sheet conveyance method according to claim 10, wherein controlling includes switching the sheet conveyance speed at the fixing unit to the predetermined sheet conveyance speed in a case where a state in which controlling includes detecting that one of loop amounts of the sheet at detection positions of the second detection and the third detection is greater than the predetermined amount based on the signal from the one of the second detection and the third detection and another one of loop amounts of the sheet at detection positions of the second detection and the third detection detects is less than the predetermined amount based on the signal from the another detection has been continued for a predetermined period of time.

12. The sheet conveyance method according to claim 10, wherein the predetermined sheet conveyance speed is a speed approximately intermediate between the first sheet conveyance speed and the second sheet conveyance speed.

13. The sheet conveyance method according to claim 10, wherein loop detection positions of the second detection and the third detection are upstream of a loop detection position of the first detection in a sheet conveyance direction.

* * * * *